US007243403B2

(12) United States Patent
Hoffman

(10) Patent No.: US 7,243,403 B2
(45) Date of Patent: Jul. 17, 2007

(54) BUCKLE SAFETY DEVICE

(76) Inventor: John Hoffman, 9 Strawberry La., Lancaster, PA (US) 17602

( * ) Notice: Subject to any disclaimer, the term of this patent is extended or adjusted under 35 U.S.C. 154(b) by 126 days.

(21) Appl. No.: 10/985,098

(22) Filed: Nov. 10, 2004

(65) Prior Publication Data

US 2006/0096069 A1 May 11, 2006

(51) Int. Cl.
*A44B 11/25* (2006.01)

(52) U.S. Cl. ..... 24/633; 24/265 BC

(58) Field of Classification Search ..... 24/633–650, 24/265 BC, 265 R; 280/801.1, 808
See application file for complete search history.

(56) References Cited

U.S. PATENT DOCUMENTS

| | | | | |
|---|---|---|---|---|
| 3,484,908 | A | 12/1969 | Lamb | 24/230 |
| 4,497,094 | A | 2/1985 | Morris | 24/633 |
| 4,502,194 | A | 3/1985 | Morris et al. | 24/633 |
| 4,638,533 | A | 1/1987 | Gloomis et al. | 24/633 |
| 4,675,954 | A | 6/1987 | Gullickson | 24/633 |
| 4,731,912 | A | 3/1988 | Boriskie et al. | 24/633 |
| 4,878,277 | A | 11/1989 | Portuese | 24/633 |
| 4,944,530 | A * | 7/1990 | Spurrier | 24/633 |
| 4,987,662 | A | 1/1991 | Haffey et al. | 24/633 |
| 5,165,149 | A * | 11/1992 | Nihei | 24/633 |
| 5,307,544 | A | 5/1994 | Quarberg et al. | 24/633 |
| 5,542,590 | A * | 8/1996 | Pfitzenmaier | 24/633 |
| 5,617,617 | A * | 4/1997 | Gustin | 24/633 |
| 5,987,716 | A * | 11/1999 | Arai | 24/633 |
| 6,769,157 | B1 * | 8/2004 | Meal | 24/633 |
| 6,988,297 | B2 * | 1/2006 | Willard et al. | 24/633 |
| 2004/0255438 | A1 * | 12/2004 | Benedict | 24/633 |
| 2005/0204523 | A1 * | 9/2005 | Smith | 24/633 |

FOREIGN PATENT DOCUMENTS

WO WO84/01275 * 4/1984

* cited by examiner

*Primary Examiner*—Robert J. Sandy
*Assistant Examiner*—Ruth C. Rodriguez
(74) *Attorney, Agent, or Firm*—Barley Snyder LLC

(57) ABSTRACT

A buckle safety device formed for use with a seat belt assembly. The seat belt assembly includes a tongue and a buckle. The buckle safety device includes a housing having a cutout and a buckle receiving opening. The cutout and the buckle receiving opening communicate with a cavity inside the housing. The cutout is configured for receiving an elongated object for releasing the tongue from the buckle when the tongue is mated therewith. A base receiving member extends from the housing. The base receiving member is arranged proximate the buckle receiving opening and has a base receiving slot extending therethrough.

15 Claims, 6 Drawing Sheets

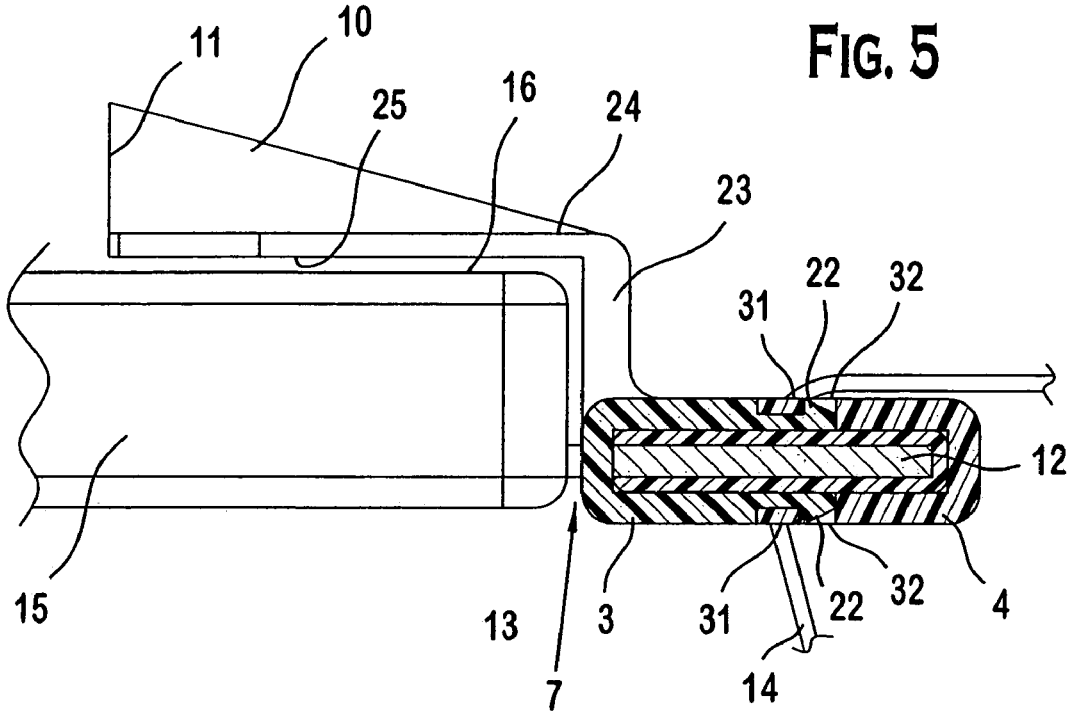
FIG. 5
FIG. 6
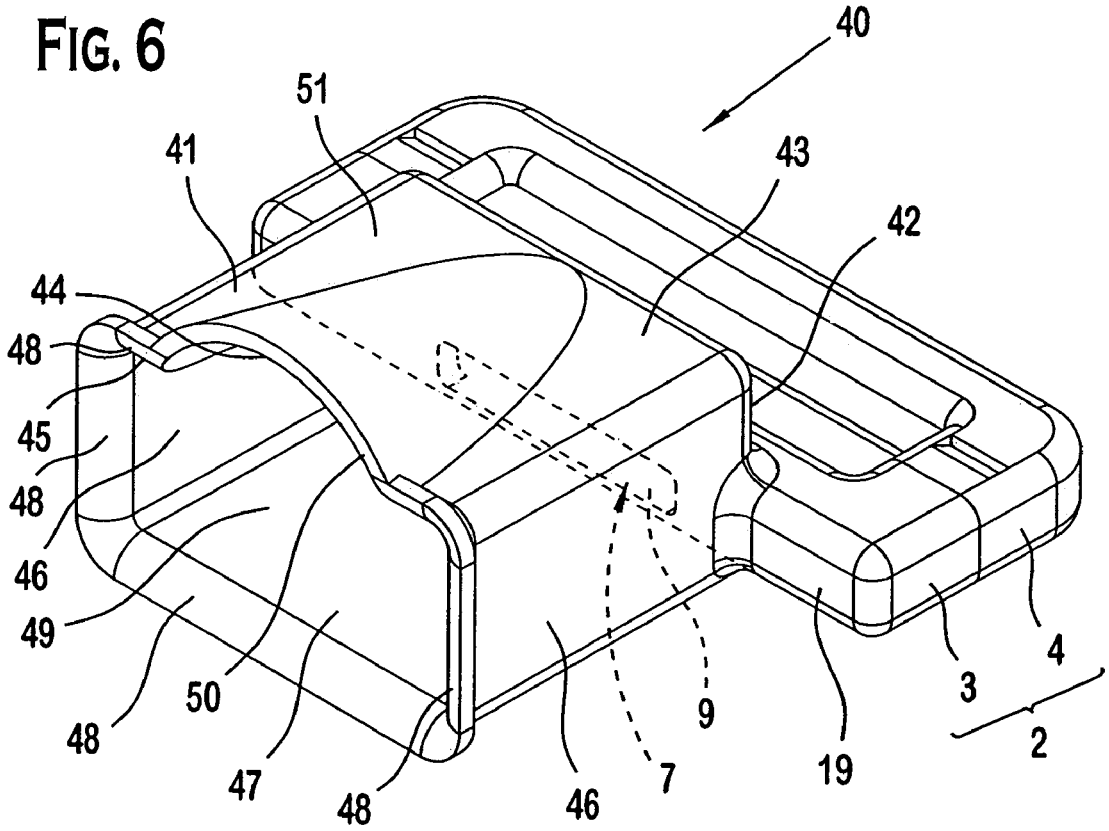

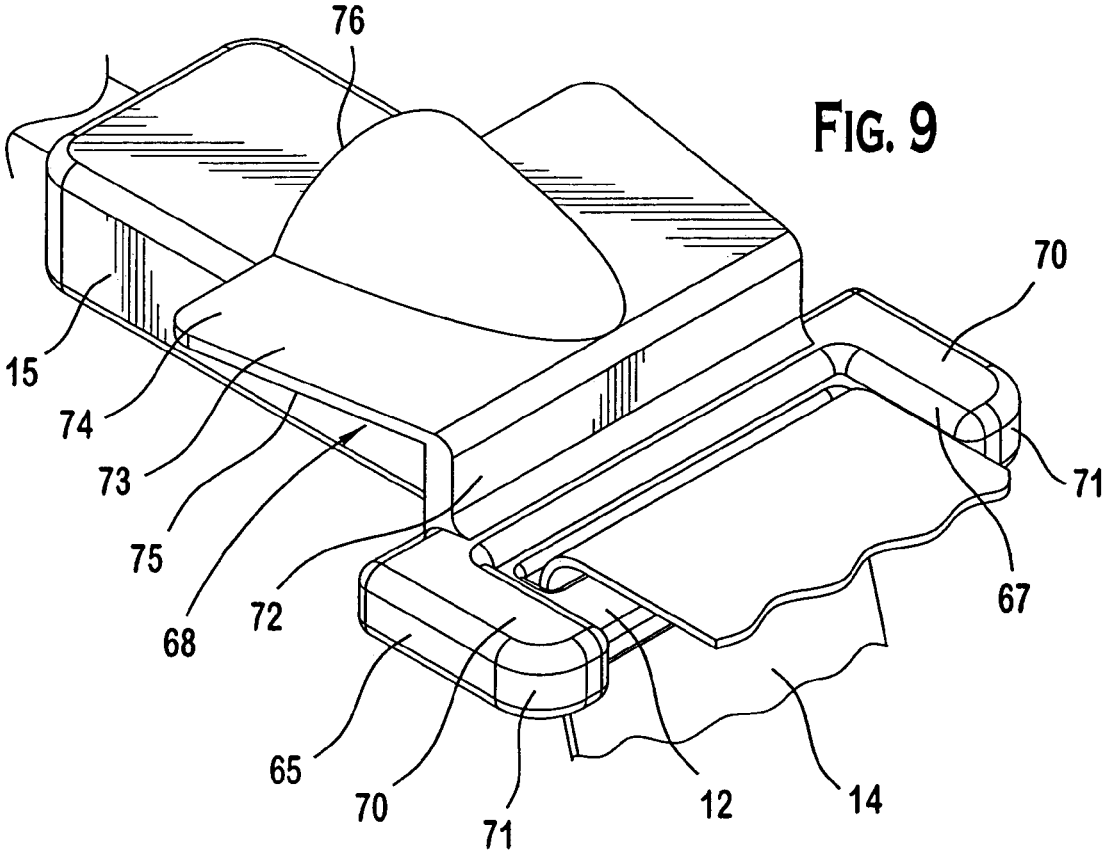
FIG. 9
FIG. 10
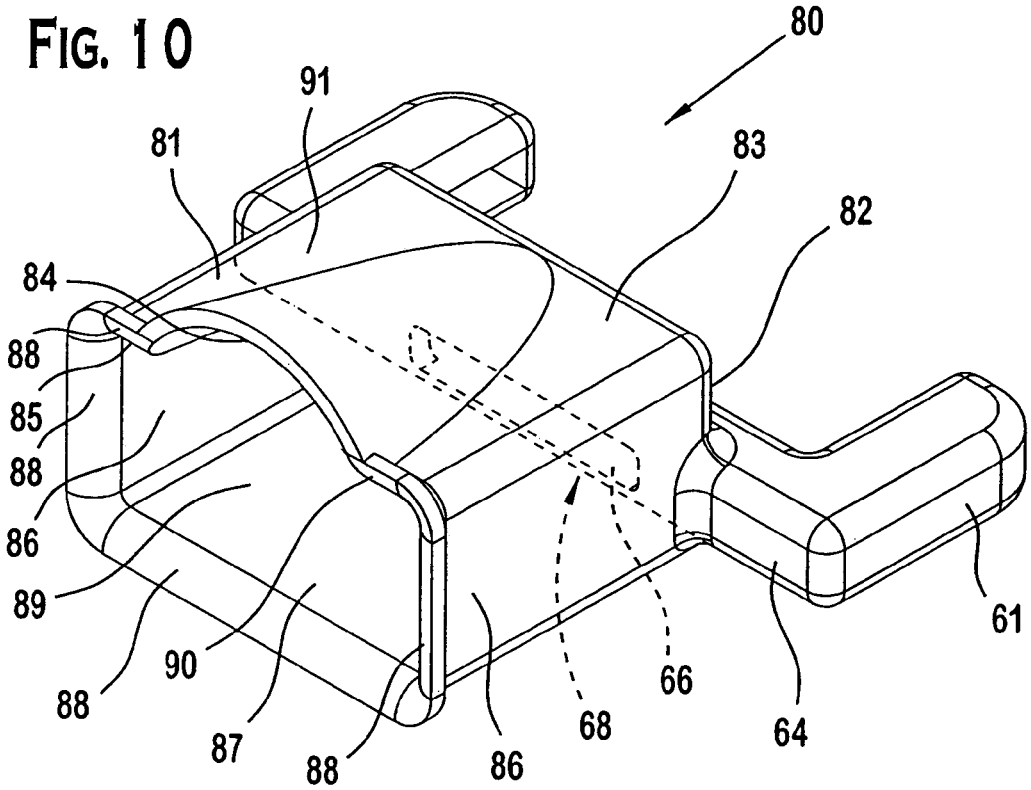

BUCKLE SAFETY DEVICE

FIELD OF THE INVENTION

The invention relates to seat belt assemblies and, more particularly, to a buckle safety device for a seat belt assembly.

BACKGROUND OF THE INVENTION

For safety purposes, children are often restrained in a vehicle seat, child safety seat, etc. with a conventional seat belt assembly. The seat belt assembly may include, for example, a base with a tongue and a buckle. The tongue is inserted into the buckle and latched therein to lock the seat belt assembly. To unlock the seat belt assembly, a release button on the buckle is manually pushed to unlatch the tongue from the buckle. Because the release button is in open view and is easily accessible, children are capable of intentionally or inadvertently pressing the release button and unlocking the seat belt assembly. This can be extremely dangerous in that the child can endure harm if not properly restrained, especially if an adult supervising the child is unaware that the child has become unrestrained.

It is therefore desirable to develop a buckle safety device that can be used with any seat belt assembly, including those provided on child safety seats, wherein the buckle safety device prevents a child from unlocking the seat belt assembly and ensures that the child remains safely restrained. It is further desirable to develop a buckle safety device that can remain attached to the seat belt assembly between uses such that use of the buckle safety device is simplified and misplacement of the buckle safety device can be prevented.

SUMMARY OF THE INVENTION

The invention relates to a buckle safety device for a seat belt assembly that includes a tongue and a buckle. The buckle safety device includes a housing having a base receiving cavity for receiving a base of the tongue. The housing has an end wall with a tongue receiving slot communicating with the base receiving cavity. The tongue receiving slot is arranged proximate a mating interface that is on an outside of the housing. A cover extends from the housing and has a free end for positioning adjacent to a release button on the buckle. The free end has a recessed surface for allowing limited access to the release button.

The invention further relates to a buckle safety device for a seat belt assembly that includes a tongue and a buckle. The buckle safety device includes a first housing member having a pair of first arms. Each of the first arms has a first locking member for securing the first housing member to a base of the tongue. The first housing member has a base receiving cavity for receiving the base and a tongue receiving slot communicating with the base receiving cavity for receiving the tongue. A cover extends from the first housing member adjacent to the tongue receiving slot. The cover has an inner surface for positioning adjacent to a release button on the buckle. The inner surface has a recessed surface for allowing limited access to the release button.

The invention still further related to a buckle safety device for a seat belt assembly that includes a tongue and a buckle. The buckle safety device includes a housing having a cutout and a buckle receiving opening. The cutout and the buckle receiving opening communicate with a cavity inside the housing. A base receiving member extends from the housing. The base receiving member is arranged proximate the buckle receiving opening and has a base receiving slot extending therethrough.

BRIEF DESCRIPTION OF THE DRAWINGS

FIG. 5 is a partial sectional view of the buckle safety device of FIG. 1 taken along line 5—5 of FIG. 4;

FIG. 6 is a perspective view of a second embodiment of a buckle safety device;

FIG. 9 is perspective view of the buckle safety device of FIG. 7 shown fully assembled with the seat belt assembly;

FIG. 10 is a perspective view of a fourth embodiment of a buckle safety device;

DETAILED DESCRIPTION OF THE INVENTION

Figure 1:
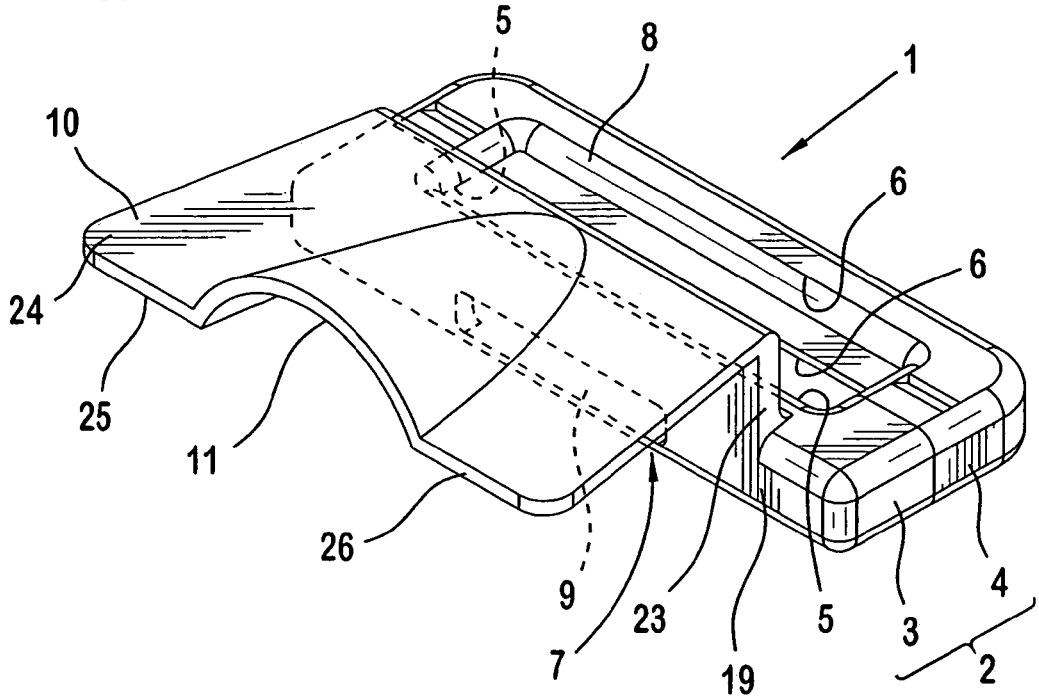
FIG. 1 is a perspective view of a first embodiment of a buckle safety device.
Figure 2:
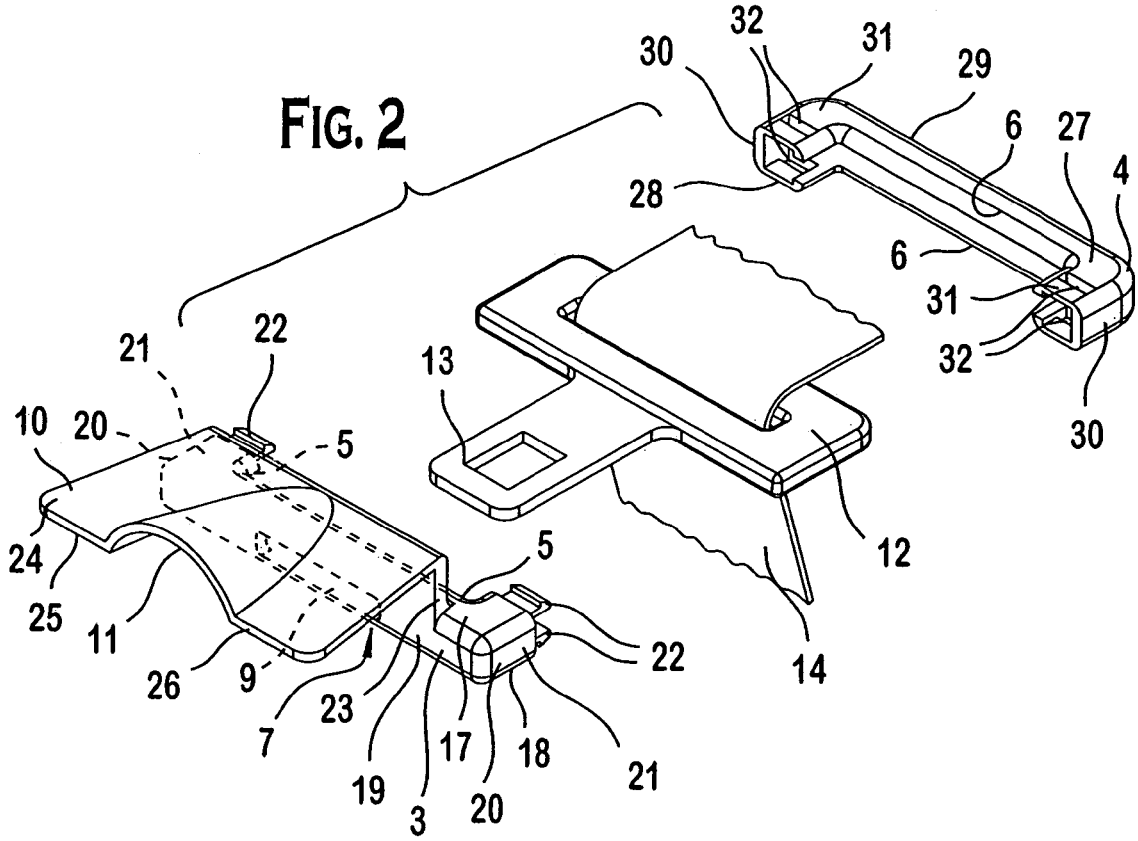
FIG. 2 is an exploded view of the buckle safety device of FIG. 1 showing attachment of the buckle safety device to a base of a tongue of a seat belt assembly.
Figure 3:
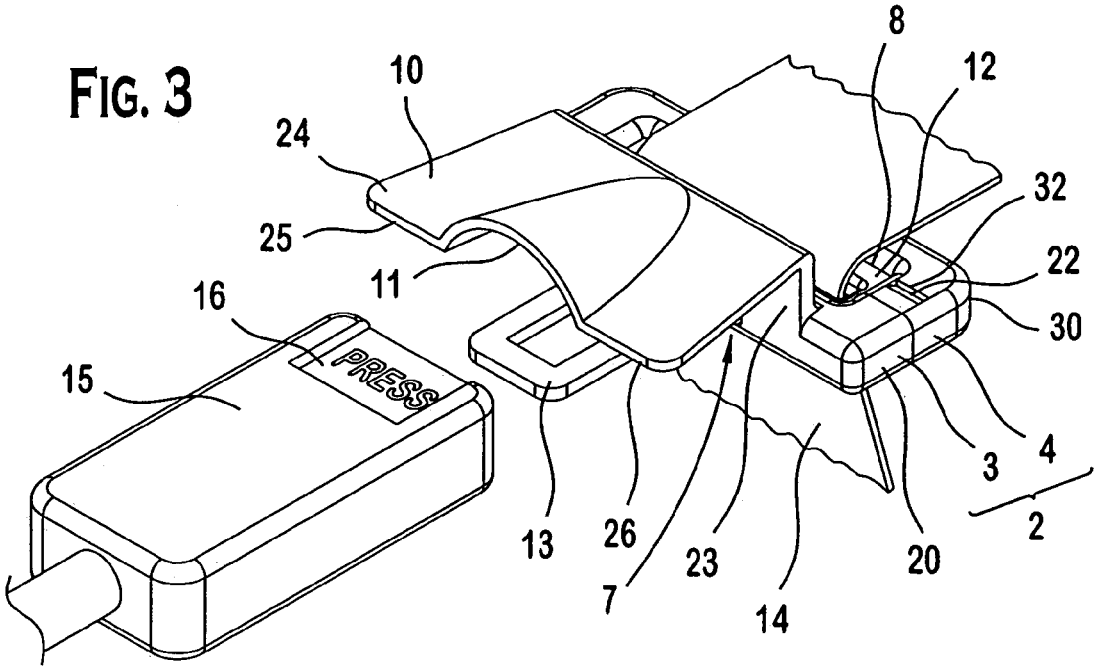
FIG. 3 is a perspective view of the buckle safety device of FIG. 1 showing the buckle safety device attached to the base of the tongue and arranged for receipt of a buckle of the seat belt assembly.
Figure 4:
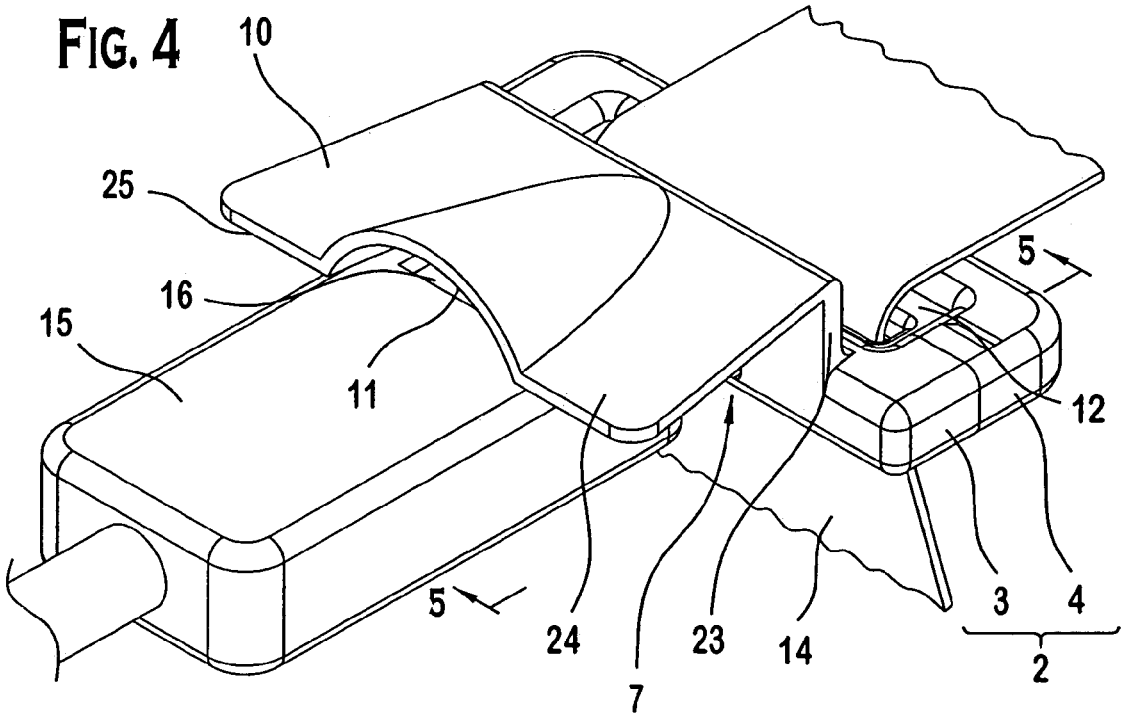
FIG. 4 is perspective view of the buckle safety device of FIG. 1 shown fully assembled with the seat belt assembly.

FIGS. 1–5 show a first embodiment of a buckle safety device 1. The buckle safety device 1 may be used with any conventional seat belt assembly, such as a seat belt assembly in a standardized vehicle, on a child safety seat, etc. As shown in FIG. 1, the buckle safety device 1 includes a housing 2 consisting of a first housing member 3 and a second housing member 4. The first and second housing members 3, 4, have first and second cutouts 5, 6 that communicate with a base receiving cavity 8. At a mating interface 7, the first housing member 3 has a tongue receiving slot 9. A cover 10 extends from the first housing member 3 adjacent to the tongue receiving slot 9 and has a recessed surface 11 formed therein. As shown in FIGS. 2–3, the seat belt assembly includes a belt 14 that extends through a base 12 of a tongue 13. The housing 2 is attached to the base 12 such that the tongue 13 extends through the tongue receiving slot 9 of the first housing member 3 and projects from the tongue receiving slot 9 adjacent to the cover 10. As shown in FIGS. 4–5, the tongue 13 is then inserted into an end of a buckle 15 of the seat belt assembly to lock the tongue 13 to the buckle 15. When the tongue 13 is locked to the buckle 15, the cover 10 extends over the buckle 15 and substantially adjacent to a tongue release button 16 on the buckle 15 to prevent a child from intentionally or inadvertently pressing the tongue release button 16 and unlocking the seat belt assembly.

The individual elements of the first embodiment of the buckle safety device 1 will now be described in greater detail. As shown in FIG. 1, the housing 2 includes the first housing member 3 and the second housing member 4. As shown in FIG. 2, the first housing member 3 includes a top surface 17, a bottom surface 18, an end surface 19, and side surfaces 20. The top surface 17, the bottom surface 18, the end surface 19, and the side surfaces 20 define a portion of the base receiving cavity 8. The tongue receiving slot 9 is formed in the end surface 19 proximate the mating interface 7. One of the first cutouts 5 is formed in the top surface 17 and the other of the first cutouts 5 is formed in the bottom surface 18. As shown in FIG. 2, the first cutouts 5 are substantially c-shaped and define a pair of first arms 21. Each of the first arms 21 has a first locking member 22. In the illustrated embodiment, the first locking members 22 are each formed as a pair of resilient latching projections, however, it will be appreciated by those skilled in the art that other types of locking members may be used. Additionally, the shape of the first cutouts 5 may be varied.

On a side of the end surface 19, an extension 23 extends upward from the top surface 17 of the first housing member 3. In the illustrated embodiment, the extension 23 extends substantially perpendicular to the top surface 17, however, it will be appreciated by those skilled in the art that the extension 23 may extend at other angles relative to the top surface 17 to account for variations in the shape of the buckle 15 of the seat belt assembly and the positioning of the release button 16 thereon. The cover 10 extends from an end of the extension 23 away from the end surface 19 in a direction opposite from the first arms 21 and substantially parallel to the top surface 17. The cover has an outer surface 24, an inner surface 25, and a free end 26. The recessed surface 11 is formed on the inner surface 25 and extends from the free end 26 of the cover 10 toward the extension 23. In the illustrated embodiment, the recessed surface 11 is substantially conical in shape, however, it will be appreciated by those skilled in the art that the recessed surface 11 may be any of a variety of shapes. The cover 10 has a length from the end of the extension 23 to the free end 26 such that the cover 10 substantially covers the release button 16 on the buckle 15 when positioned adjacent thereto.

As shown in FIG. 2, the second housing member 4 includes a top surface 27, a bottom surface 28, an end surface 29, and side surfaces 30. The top surface 27, the bottom surface 28, the end surface 29, and the side surfaces 30 define another portion of the base receiving cavity 8. One of the second cutouts 6 is formed in the top surface 27 and the other of the second cutouts 6 is formed in the bottom surface 28. As shown in FIG. 2, the second cutouts 6 may be substantially c-shaped and define a pair of second arms 31. Each of the second arms 31 has a second locking member 32. In the illustrated embodiment, the second locking member 32 is formed as a pair of apertures corresponding to the latching projections of the first locking members 22, however, it will be appreciated by those skilled in the art that other types of locking members may be used. Additionally, the shape of the second cutouts 6 may be varied. The buckle safety device 1 may be formed, for example, from a molded plastic material.

As shown in FIG. 2, to assemble the buckle safety device 1 to the base 12 of the tongue 13, the first housing member 3 is inserted onto a first end of the base 12 of the tongue 13 such that the tongue 13 is received in the tongue receiving slot 9 and the base 12 is received in the base receiving cavity 8. The tongue 13 extends through the tongue receiving slot 9 and projects from the tongue receiving slot 9 adjacent to the cover 10, as shown in FIG. 3. As shown in FIG. 2, the second housing member 4 is inserted onto a second end of the base 12 of the tongue 13 such that the base 12 is received in the base receiving cavity 8, and the second locking members 32 engage with the first locking members 22 to attach the first housing member 3 to the second housing member 4. In this position, the base 12 is arranged in the base receiving cavity 8 such that the belt 14 extends through the first and second cutouts 6, 7, as shown in FIG. 3.

As shown in FIG. 2, during operation, the tongue 13 is inserted into the end of the buckle 15 to latch the tongue 13 to the buckle 15. Because the mating interface 7 is outside of the housing 2, the tongue 13 is latched to the buckle 15 outside of the housing 2. As shown in FIGS. 4–5, when the tongue 13 is latched to the buckle 15, the cover 10 extends substantially parallel to a major surface of the buckle 15. The inner surface 25 of the cover 10 is arranged proximate to an outside surface of the buckle 15, and the recessed surface 11 is positioned adjacent to the release button 16. Since the cover 10 substantially covers the release button 16, it is difficult for a child, but not an adult, to access the release button 16. The cover 10 thereby prevents the child from intentionally or inadvertently pressing the release button 16 and unlocking the seat belt assembly. Although in the illustrated embodiment, the release button 16 is arranged on a top surface of the buckle 15, it will be appreciated by those skilled in the art that the buckle safety device 1 may also be used with buckles having a release button arranged on an end surface thereof, such as the buckle 115 shown in FIG. 11, by changing the angular position of the extension 23 and/or the cover 10.

To release the tongue 13 from the buckle 15, an adult inserts their finger (not shown) or other elongated object, such as a pencil, key, etc., into the recessed surface 11 between the inside surface 25 of the cover 10 and the buckle 15. The adult then presses the release button 16 to release the tongue 13 from the buckle 15 thereby unlocking the seat belt assembly. After the seat belt assembly is unlocked, the buckle safety device 1 remains attached to the base 12 of the tongue 13 for repeated use. To remove the buckle safety device 1 from the base 12 of the tongue 13, the first and second locking members 22, 32 are unlatched by pressing the latching projections of the first locking members 22 together and removing the latching projections from the apertures of the second locking members 32. The buckle safety device 1 can then be re-attached to another seat belt assembly or stored for later use.

FIG. 6 shows a second embodiment of a buckle safety device 40. As shown in FIG. 6, the buckle safety device 40 is identical to the first embodiment of the buckle safety device 1, except the buckle safety device 40 has a cover 41 formed as a sleeve. Elements of the buckle safety device 40 that are identical to elements of the first embodiment of the buckle safety device 1 will be referenced using the same reference numerals and will not be explained in further detail hereafter.

As shown in FIG. 6, the cover 41 has a rear wall 42 that extends upward from the end surface 19 and substantially parallel thereto. A top wall 51 extends from an end of the rear wall 42 away from the end surface 19 in a direction opposite from the first arms 21 and substantially perpendicular to the rear wall 42. The top wall 51 has an outer surface 43 and an inner surface 45. A recessed surface 44 is formed on the inner surface 45 and extends from a free end 50 of the cover 41 toward the rear wall 42. In the illustrated embodiment, the recessed surface 44 is substantially conical in shape, however, it will be appreciated by those skilled in the art that the recessed surface 44 may be any of a variety of shapes. Opposite from the top wall 51 and substantially parallel thereto, a bottom wall 47 extends from the end surface 19 substantially below the tongue receiving slot 9. Side walls 46 extend between the top wall 51 and the bottom wall 47. The top wall 51, bottom wall 47, side walls 46, rear wall 42, and end surface 19 define a buckle receiving passage 49. The top wall 51, bottom wall 47, and side walls 46 may be formed to have beveled edges 48 to facilitate insertion of the buckle 15 into the buckle receiving passage 49. The cover 41 has a length from the rear wall 42 to the free end 50 such that the top wall 51 of the cover 41 substantially covers the release button 16 on the buckle 15 when the buckle 15 positioned in the buckle receiving passageway 49.

The buckle safety device 40 is assembled and operates in the same manner as the first embodiment of the buckle safety device 1, except that the buckle 15 is received in the buckle receiving passage 49 when the tongue 13 is inserted into the end of the buckle 15 to latch the tongue 13 to the buckle 15. Because the mating interface 7 is outside of the housing 2, the tongue 13 is latched to the buckle 15 outside of the housing 2. When the tongue 13 is latched to the buckle 15, the top wall 51 of the cover 41 extends substantially parallel to the major surface of the buckle 15. The inner surface 45 of the top wall 51 is arranged proximate to the outside surface of the buckle 15 such that the recessed surface 44 is positioned adjacent to the release button 16. The cover 41 therefore makes it difficult for the child, but not the adult, to access the release button 16. The cover 41 thereby prevents the child from intentionally or inadvertently pressing the release button 16 and unlocking the seat belt assembly.

Figure 7:
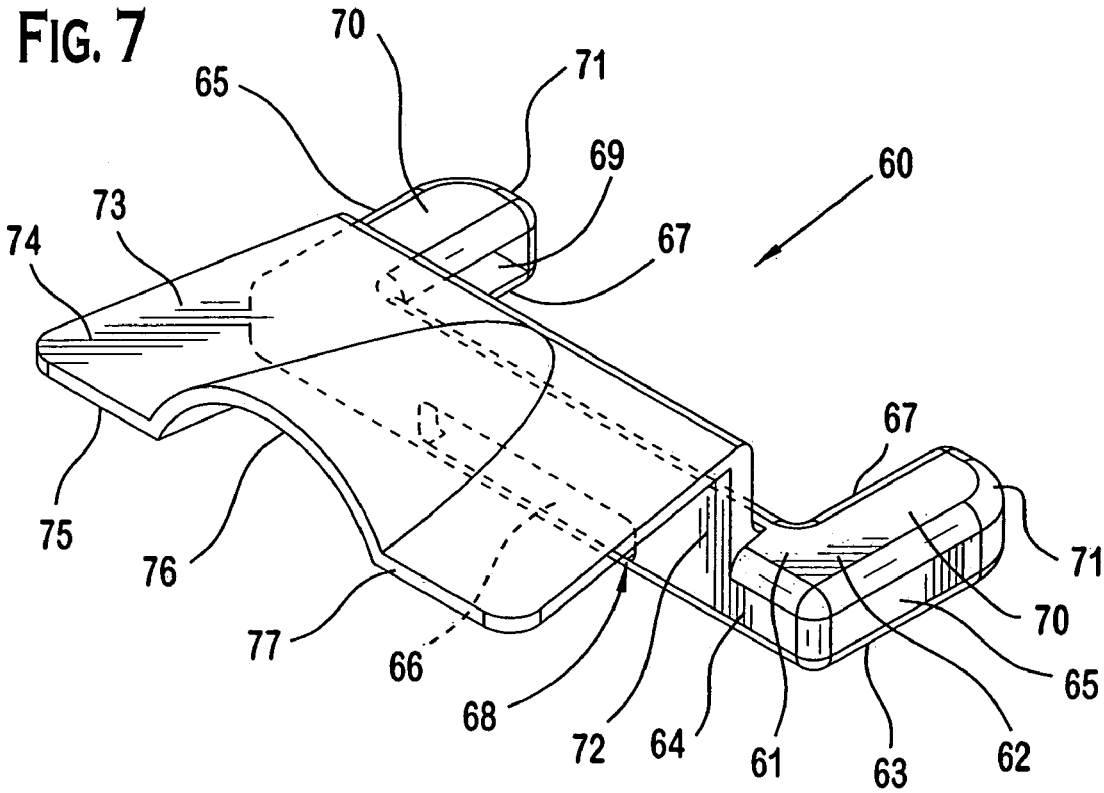
FIG. 7 is a perspective view of a third embodiment of a buckle safety device.
Figure 8:
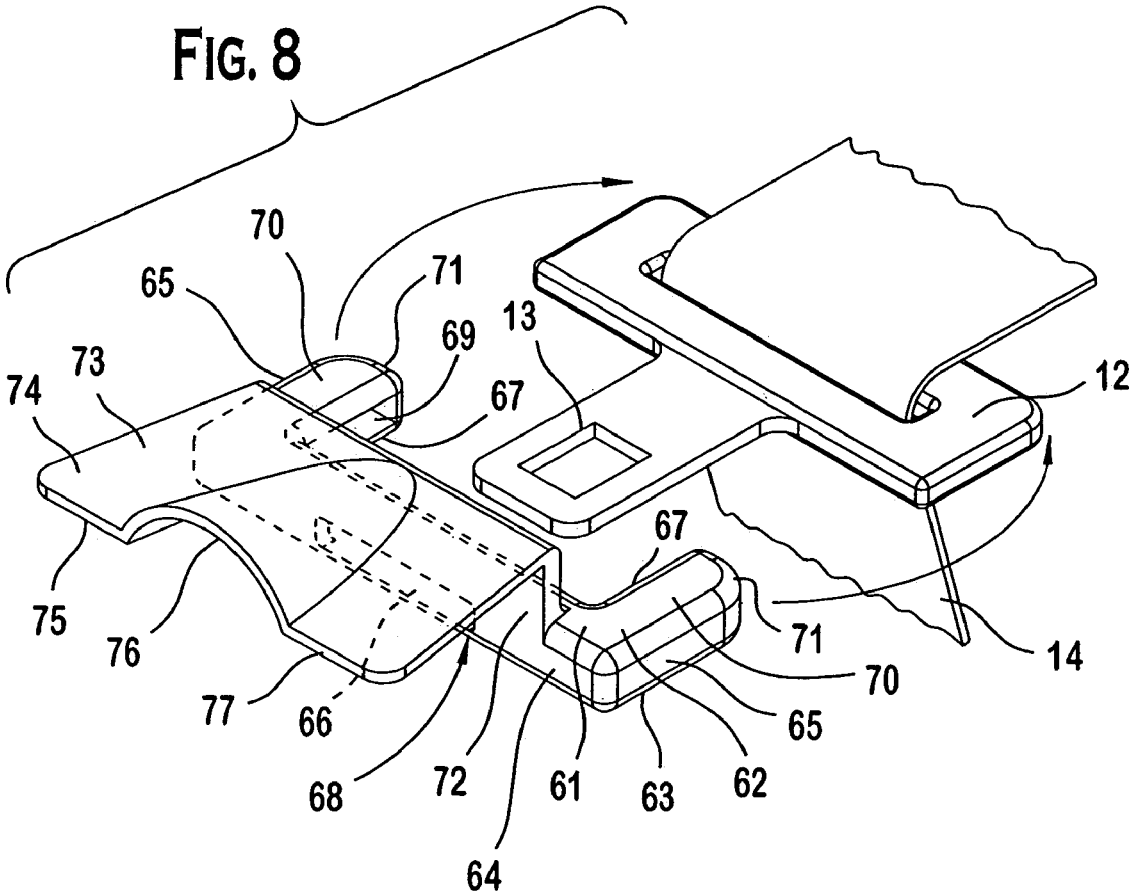
FIG. 8 is a perspective view of the buckle safety device of FIG. 7 showing attachment of the buckle safety device to the base of the tongue of the seat belt assembly.

FIGS. 7–9 show a third embodiment of a buckle safety device 60. As shown in FIG. 7, the buckle safety device 60 has a housing 61. The housing 61 includes a top surface 62, a bottom surface 63, an end surface 64, and side surfaces 65. The top surface 62, the bottom surface 63, the end surface 64, and the side surfaces 65 define a base receiving cavity 69. A tongue receiving slot 66 is formed in the end surface 64 proximate a mating interface 68. A pair of first cutouts 67 is formed in the housing 61. One of the first cutouts 67 is formed in the top surface 62 and the other of the first cutouts 67 is formed in the bottom surface 63. The first cutouts 67 may be substantially c-shaped and define a pair of resilient first arms 70. Each of the first arms 70 has a first locking member 71. The first arms 70 have a length from the end surface 64 to the first locking member substantially the same as a length of the base 12 of the tongue 13. In the illustrated embodiment, the first locking member 71 is a closed outer surface, however, it will be appreciated by those skilled in the art that other types of locking members may be used. Additionally, the shape of the first cutouts 67 may be varied.

On a side of the end surface 64, an extension 72 extends upward from the top surface 62 of the housing 71. In the illustrated embodiment, the extension 72 extends substantially perpendicular to the top surface 62, however, it will be appreciated by those skilled in the art that the extension 72 may extend at other angles relative to the top surface 62 to account for variations in the shape of the buckle 15 of the seat belt assembly and the positioning of the release button 16 thereon. A cover 73 extends from an end of the extension 72 away from the end surface 72 in a direction opposite from the first arms 70 and substantially parallel to the top surface 62. The cover 73 has an outer surface 74, an inner surface 75, and a free end 77. A recessed surface 76 is formed on the inner surface 75 and extends from the free end 77 of the cover 73 toward the extension 72. In the illustrated embodiment, the recessed surface 76 is substantially conical in shape, however, it will be appreciated by those skilled in the art that the recessed surface 76 may be any of a variety of shapes. The cover 73 has a length from the end of the extension 72 to the free end 77 such that the cover 73 substantially covers the release button 16 on the buckle 15 when positioned adjacent thereto. The buckle safety device 60 may be formed, for example, from a molded plastic material.

As shown in FIG. 8, to assemble the buckle safety device 60 to the base 12 of the tongue 13, the housing member 71 is inserted onto a first end of the base 12 by pulling the first arms 70 away from each other and sliding the base 12 into the base receiving cavity 69 until the tongue 13 is received in the tongue receiving slot 66. The first arms 70 are then released and resile toward each other such that the closed end portions 71 rest on an end of the base 12. The first arms 70 and the closed end portions 71 thereby secure the housing 61 to the base 12. The tongue 13 extends through the tongue receiving slot 66 and projects from the tongue receiving slot 66 adjacent to the cover 73, as shown in FIG. 9. In this position, the base 12 is arranged in the base receiving cavity 69 such that the belt 14 extends through the first cutouts 67.

As shown in FIG. 9, during operation, the tongue 13 is inserted into the end of the buckle 15 to latch the tongue 13 to the buckle 15. Because the mating interface 68 is outside of the housing 61, the tongue 13 is latched to the buckle 15 outside of the housing 61. When the tongue 13 is latched to the buckle 15, the cover 73 extends substantially parallel to the major surface of the buckle 15. The inner surface 75 of the cover 73 is arranged proximate to the outside surface of the buckle 15, and the recessed surface 76 is positioned adjacent to the release button 16. Since the cover 73 substantially covers the tongue release button 16, it is difficult for the child, but not the adult, to access the release button 16. The cover 73 thereby prevents the child from intentionally or inadvertently pressing the release button 16 and unlocking the seat belt assembly. Although in the illustrated embodiment, the release button 16 is arranged on a top surface of the buckle 15, it will be appreciated by those skilled in the art that the buckle safety device 60 may also be used with buckles having a release button arranged on an end surface thereof, such as the buckle 115 shown in FIG. 11, by changing the angular position of the extension 72 and/or the cover 73.

To release the tongue 13 from the buckle 15, the adult inserts their finger (not shown) or other elongated object, such as a pencil, key, etc., into the recessed surface 76 between the inside surface 76 of the cover 71 and the buckle 15. The adult then presses the release button 16 to release the tongue 13 from the buckle 15 thereby unlocking the seat belt assembly. After the seat belt assembly is unlocked, the buckle safety device 60 remains attached to the base 12 of the tongue 13 for repeated use. To remove the buckle safety device 60 from the base 12 of the tongue 13, the first arms 70 are pulled away from the base 12 until the closed end portions 71 are released from the end of the base 12. The buckle safety device 60 can then be re-attached to another seat belt assembly or stored for later use.

FIG. 10 shows a fourth embodiment of a buckle safety device 80. As shown in FIG. 10, the buckle safety device 80 is identical to the third embodiment of the buckle safety device 60, except the buckle safety device 80 has a cover 81 formed as a sleeve. Elements of the buckle safety device 80 that are identical to elements of the third embodiment of the buckle safety device 60 will be referenced using the same reference numerals and will not be explained in further detail hereafter.

As shown in FIG. 10, the cover 81 has a rear wall 82 that extends upward from the end surface 64 and substantially parallel thereto. A top wall 91 extends from an end of the rear wall 82 away from the end surface 64 in a direction opposite from the first arms 70 and substantially perpendicular to the rear wall 82. The top wall 91 has an outer surface 83 and an inner surface 85. A recessed surface 84 is formed on the inner surface 85 and extends from a free end 90 of the cover 81 toward the rear wall 82. In the illustrated embodiment, the recessed surface 84 is substantially conical in shape, however, it will be appreciated by those skilled in the art that the recessed surface 84 may be any of a variety of shapes. Opposite from the top wall 91 and substantially parallel thereto, a bottom wall 87 extends from the end surface 64 substantially below the tongue receiving slot 66. Side walls 86 extend between the top wall 91 and the bottom wall 87. The top wall 91, bottom wall 87, side walls 86, rear wall 82, and end surface 64 define a buckle receiving passage 89. The top wall 91, bottom wall 87, and side walls 86 may be formed to have beveled edges 88 to facilitate insertion of the buckle 15 into the buckle receiving passage 89. The cover 81 has a length from the rear wall 82 to the free end 90 such that the top wall 91 of the cover 81 substantially covers the release button 16 on the buckle 15 when the buckle 15 is positioned in the buckle receiving passageway 89.

The buckle safety device 80 is assembled and operates in the same manner as the third embodiment of the buckle safety device 60, except that the buckle 15 is received in the buckle receiving passage 89 when the tongue 13 is inserted into the end of the buckle 15 to latch the tongue 13 to the buckle 15. Because the mating interface 68 is outside of the housing 61, the tongue 13 is latched to the buckle 15 outside of the housing 61. When the tongue 13 is latched to the buckle 15, the top wall 91 of the cover 81 extends substantially parallel to the major surface of the buckle 15. The inner surface 84 of the top wall 91 is arranged proximate to an outside surface of the buckle 15 such that the recessed surface 84 is arranged adjacent to the release button 16. The cover 81 therefore makes it difficult for the child, but not the adult, to access the release button 16. The cover 41 thereby prevents the child from intentionally or inadvertently pressing the release button 16 and unlocking the seat belt assembly.

Figure 11:
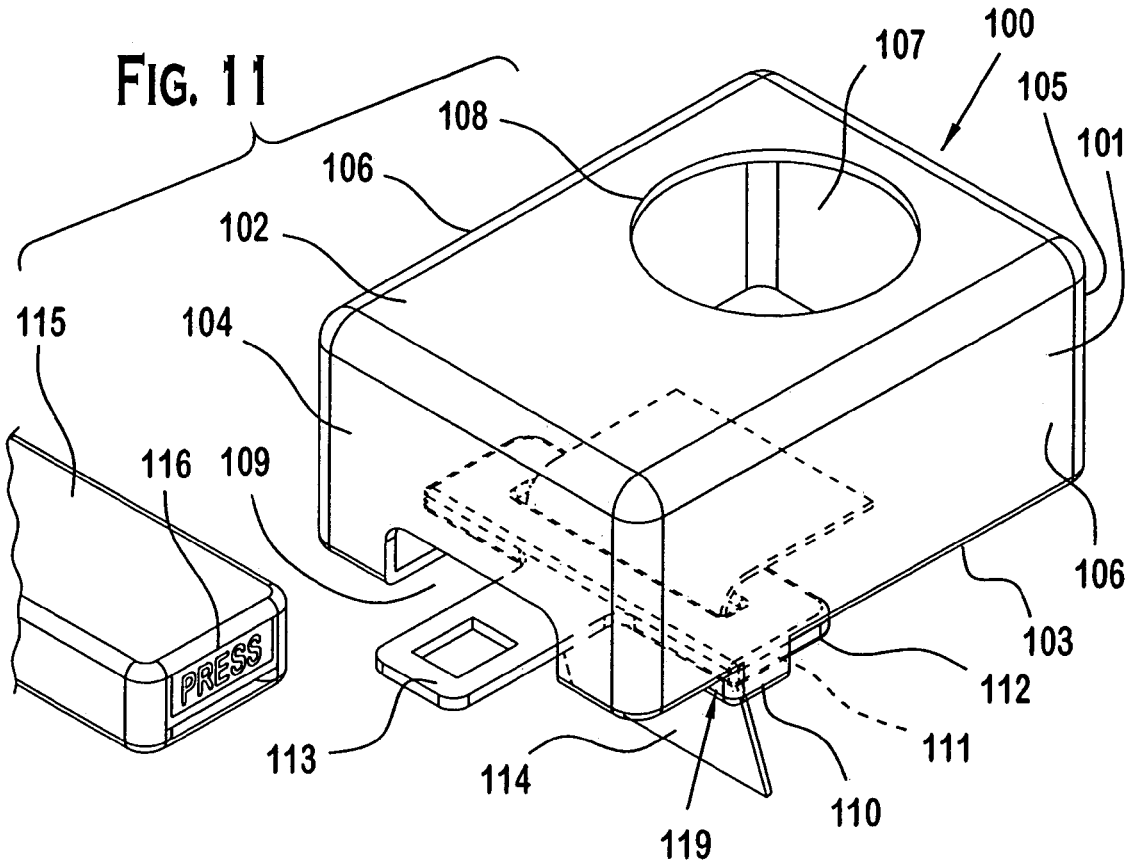
FIG. 11 is a perspective view of a fifth embodiment of a buckle safety device showing the buckle safety device attached to the base of the tongue and arranged for receipt of a buckle of the seat belt assembly.
Figure 12:
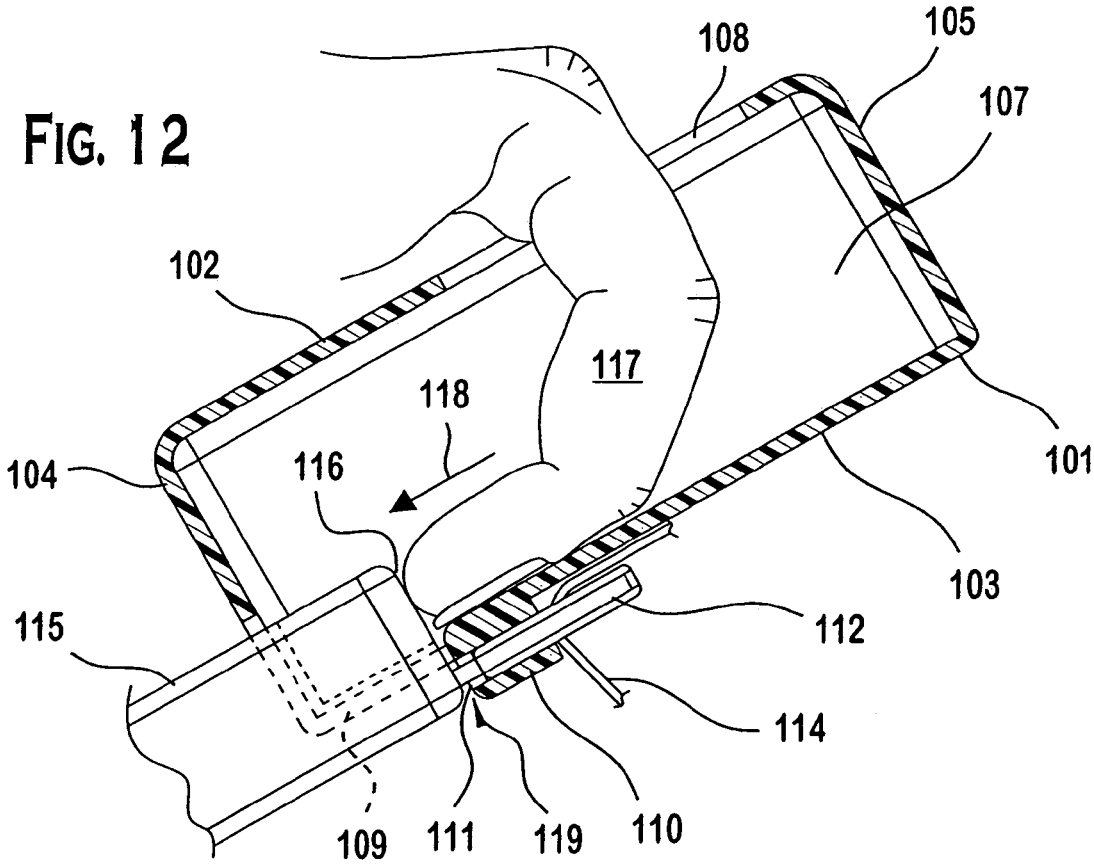
FIG. 12 is a partial sectional view of the buckle safety device of FIG. 11 showing attachment of the buckle safety device to the base of the tongue of the seat belt assembly.

FIGS. 11–12 show a fifth embodiment of a buckle safety device 100. As shown in FIG. 11, the buckle safety device 100 has a housing 101. The housing 101 includes a top surface 102, a bottom surface 103, a first end surface 104, a second end surface 105, and side surfaces 106. The top and bottom surfaces 102, 103, the first and second end surfaces 104, 105, and the side surfaces 106 define a cavity 107. The top surface 102 has a cutout 108 that communicates with the cavity 107. The cutout 108 is formed at a position closer to the second end surface 105 than the first end surface 104. In the illustrated embodiment, the cutout 108 is substantially round and is formed in the top wall 102, however, it will be appreciated by those skilled in the art that the cutout 108 may be any of a variety of shapes and may be formed on the first or second end surfaces 104, 105 or the side surfaces 106. The second end surface 105 and the bottom surface 103 have a buckle receiving opening 109 that communicates with the cavity 107. A base receiving member 110 extends from the bottom surface 103 of the housing 101 proximate the buckle receiving opening 109 at a mating interface 119. As shown in FIG. 12, the base receiving member 110 has a base receiving slot 111 extending therethrough. The buckle safety device 100 may be formed, for example, from a molded plastic material.

As shown in FIG. 11, to assemble the buckle safety device 100 to the base 112 of the tongue 113, the tongue 113 is inserted into the base receiving slot 111 of the base receiving member 110 until the tongue 113 projects from an opposite side of the base receiving slot 111 proximate the buckle receiving opening 109, and an end portion of the base 112 is received in the base receiving slot 111. The base 112 is preferably slightly larger than the base receiving slot 111 so that the resiliency of the base receiving member 110 secures the base 112 therein.

As shown in FIG. 12, during operation, the tongue 113 is inserted into the end of the buckle 115 to latch the tongue 113 to the buckle 115. Because the mating interface 119 is outside of the housing 101, the tongue 113 is latched to the buckle 115 outside of the housing 101. As the tongue 113 is inserted into the end of the buckle 115, a portion of the buckle 115 having the release button 116 is received in the buckle receiving opening 109 so that the release button 116 is positioned within the cavity 107. Since the release button 116 is positioned within the cavity 107, it is difficult for the child, but not the adult to access the release button 116. The buckle safety device 100 thereby prevents the child from intentionally or inadvertently pressing the release button 116 and unlocking the seat belt assembly. Although in the illustrated embodiment, the release button 116 is arranged on an end of the buckle 115, it will be appreciated by those skilled in the art that the buckle safety device 100 may also be used with buckles having a release button arranged on a top surface thereof, such as the buckle 15 shown in FIG. 3.

To release the tongue 13 from the buckle 115, the adult inserts their finger 117 or other elongated object, such as a pencil, key, etc, into the cutout 108. The adult then presses the release button 116 in the direction indicated by arrow 118 to release the tongue 113 from the buckle 115 thereby unlocking the seat belt assembly. After the seat belt assembly is unlocked, the buckle safety device 100 remains attached to the base 112 of the tongue 113 for repeated use. To remove the buckle safety device 100 from the base 12 of the tongue 13, the base is pulled out of the base receiving slot 111 until it is released from the base receiving member 110. The buckle safety device 100 can then be re-attached to another seat belt assembly or stored for later use.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A buckle safety device for a seat belt assembly including a tongue and a buckle, comprising:

a housing having a cutout and a buckle receiving opening, the cutout and the buckle receiving opening communicating with a cavity inside the housing;

a base receiving member extending from the housing, the base receiving member being arranged proximate the buckle receiving opening and having a base receiving slot extending therethrough, the base receiving member being resiliently secured directly to a base of the tongue to secure the base of the tongue to the housing; and the cutout being configured for receiving an elongated object for releasing the tongue from the buckle when the tongue is mated therewith.

2. The buckle safety device of claim 1, wherein the base receiving member is arranged at a mating interface that is outside of the housing.

3. The buckle safety device of claim 1, wherein the cutout is formed on a top surface of the housing, the buckle receiving opening is formed on a first end surface and bottom surface of the housing, and the base receiving member extends from the bottom surface of the housing.

4. The buckle safety device of claim 1, wherein the buckle receiving opening is configured such that the buckle is only partially receivable inside the cavity.

5. The buckle safety device of claim 1, wherein the base receiving member extends perpendicular to a direction of insertion of the buckle into the cavity.

6. A buckle safety device for a seat belt assembly including a tongue and a buckle, comprising:

a housing having a cutout and a buckle receiving opening, the cutout and the buckle receiving opening communicating with a cavity inside the housing, the buckle receiving opening being configured such that the buckle is only partially receivable inside the cavity;

a base receiving member extending from the housing, the base receiving member being arranged proximate the buckle receiving opening and directly fixing the tongue to the housing; and the cutout being configured for receiving an elongated object for releasing the tongue from the buckle when the tongue is mated therewith.

7. The buckle safety device of claim 6, wherein the base receiving member is arranged at a mating interface that is outside of the housing.

8. The buckle safety device of claim 6, wherein the cutout is formed on a top surface of the housing, the buckle receiving opening is formed on a first end surface and bottom surface of the housing, and the base receiving member extends from the bottom surface of the housing.

9. The buckle safety device of claim 6, wherein the base receiving member is configured to resiliently secure a base of the tongue to the housing.

10. The buckle safety device of claim 6, wherein the base receiving member extends perpendicular to a direction of insertion of the buckle into the cavity.

11. A buckle safety device for a seat belt assembly including a tongue and a buckle, comprising:

a housing having a cutout and a buckle receiving opening, the cutout and the buckle receiving opening communicating with a cavity inside the housing;

a base receiving member extending from the housing perpendicular to a direction of insertion of the buckle into the cavity, the base receiving member being arranged proximate the buckle receiving opening and directly fixing the tongue to the housing; and the cutout being configured for receiving an elongated object for releasing the tongue from the buckle when the tongue is mated therewith.

12. The buckle safety device of claim 11, wherein the base receiving member is arranged at a mating interface that is outside of the housing.

13. The buckle safety device of claim 11, wherein the cutout is formed on a top surface of the housing, the buckle receiving opening is formed on a first end surface and bottom surface of the housing, and the base receiving member extends from the bottom surface of the housing.

14. The buckle safety device of claim 11, wherein the base receiving member is configured to resiliently secure a base of the tongue to the housing.

15. The buckle safety device of claim 11, wherein the buckle receiving opening is configured such that the buckle is only partially receivable inside the cavity.

* * * * *